US008123000B2

(12) United States Patent
Whitaker

(10) Patent No.: US 8,123,000 B2
(45) Date of Patent: Feb. 28, 2012

(54) LADDER RACK

(76) Inventor: Ronald Whitaker, Baton Rouge, LA (US)

( * ) Notice: Subject to any disclaimer, the term of this patent is extended or adjusted under 35 U.S.C. 154(b) by 0 days.

(21) Appl. No.: 11/641,505

(22) Filed: Dec. 19, 2006

(65) Prior Publication Data

US 2007/0137929 A1 Jun. 21, 2007

Related U.S. Application Data

(60) Provisional application No. 60/751,888, filed on Dec. 20, 2005.

(51) Int. Cl.
*E06C 5/32* (2006.01)

(52) U.S. Cl. ..... 182/129; 248/238

(58) Field of Classification Search ..... 182/129; 248/210, 238

See application file for complete search history.

(56) References Cited

U.S. PATENT DOCUMENTS 789,034 A * 5/1905 Jones ..... 248/237
1,155,125 A * 9/1915 Blankenhagen ..... 182/212
4,121,692 A * 10/1978 Morawski ..... 182/129
4,241,807 A * 12/1980 McKenna et al. ..... 182/121
4,318,523 A * 3/1982 Weatherly ..... 248/210
4,702,446 A * 10/1987 Brown ..... 248/210
6,131,699 A * 10/2000 Leak, Jr. ..... 182/129
6,254,045 B1 * 7/2001 Oatsvall ..... 248/210
7,063,187 B1 * 6/2006 Lavigne ..... 182/129

* cited by examiner

*Primary Examiner* — Alvin Chin Shue
(74) *Attorney, Agent, or Firm* — James Ray & Assoc

(57) ABSTRACT

Apparatus used on extension ladder for supporting a paint can includes a platform. A first rod support member secured to such platform in a rotateable manner. A first leg secured to platform in a pivotable manner adjacent a second outer edge. A second leg secured to platform in a pivotable manner adjacent a third outer edge. A first adjustable leg engageable with such first leg for adjusting a length between a second end of first adjustable leg member and first end of such first leg. A second adjustable leg engageable with a second end of second leg for adjusting a length between a second end of second adjustable leg and the first end of second leg member. A second rod like support is secured to platform in a rotateable manner closely adjacent a fourth outer edge and a first and second ladder insert engageable with an end of a respective one of the first and second elongated rod support member.

13 Claims, 2 Drawing Sheets

LADDER RACK

CROSS REFERENCE TO RELATED APPLICATION

This patent application is related to and claims priority from U.S. Provisional Patent Application Ser. No. 60/751,888 filed Dec. 20, 2005.

FIELD OF THE INVENTION

The present invention relates, in general, to ladder accessories and, more particularly, this invention relates to an extension ladder rack for holding accessories, such as at least one of a paint can, a paint brush, a paint scraper, etc. and, still more specifically, the invention relates to an extension ladder rack that can be used of either side of such extension ladder.

BACKGROUND OF THE INVENTION

Prior to the conception and development of the present invention, as is generally well known in the prior art, step ladders and extension ladders have been commercially available and in widespread use for many years. As is equally well known, most of these step ladders are equipped with a foldable type platform for holding a paint can in a generally horizontal plane when using such step ladder in painting objects which cannot be reached from the floor and/or ground level. Further, other tools and/or painting accessories can be placed on this foldable type platform if required.

However, because extension ladders may have different heights and can easily be placed at many different angles with respect to a wall or other object that they are being leaned against. Consequently, the prior art type platform useful for step ladders is not suitable for use with an extension type ladder.

SUMMARY OF THE INVENTION

The present invention provides an apparatus for use on an extension type ladder for at least one of holding a paint can in a substantially horizontal plane, a paint brush, a paint scraper, a wire brush and a cloth. Such apparatus includes a platform member, which when in use, is disposed in a substantially horizontal plane. The platform member having each of a predetermined shape and a predetermined thickness which is at least sufficient to hold a one gallon can full of paint. There is a first elongated rod like support member secured to such platform member in a rotatable manner closely adjacent a first predetermined outer edge thereof. Such first elongated rod like support member having a first predetermined length which is at least sufficient to extend outwardly from each of a second predetermined outer edge and a third predetermined outer edge of said platform member. A first ladder insert having each of a predetermined shape and a predetermined length is engageable with a predetermined end of the first elongated rod like member and a first aperture formed through a leg of such extension ladder. There is a first leg member secured at a first end thereof to the platform member closely adjacent such second predetermined outer edge of the platform member. The first leg member is pivotable adjacent the first end thereof. A second leg member is secured at a first end thereof to such platform member closely adjacent the third predetermined outer edge of such platform member. The second leg member is also pivotable adjacent a first end thereof. A first adjustable leg member engages at a first end thereof a second end of such first leg member for adjusting the length in order to provide a substantially horizontally disposed upper surface of such platform member during use of the apparatus. A second adjustable leg member is engageable at a first end thereof to a second end of such second leg member for adjusting the length in order to assist in providing the substantially horizontally disposed upper surface of such platform member during use of the apparatus. Further, there is a second elongated rod like support member secured to such platform member in a rotatable manner closely adjacent a fourth predetermined outer edge thereof disposed radially opposite such first outer edge of the platform member. The second elongated rod like support member has a second predetermined length which is at least sufficient to extend outwardly from each of the second predetermined outer edge and such third predetermined outer edge of the platform member. The final essential element of the apparatus is a second ladder insert having each of a predetermined shape and a predetermined length engageable with a predetermined end of such second elongated rod like member and a second aperture formed through a leg of such extension ladder.

OBJECTS OF THE INVENTION

It is, therefore, one of the primary objects of the present invention to provide a ladder rack that can be used with present day extension type ladders.

Another object of the present invention is to provide a ladder rack that can be attached to an extension ladder on either side of such extension ladder for ease of use by either a left handed person or a right handed person.

Still another object of the present invention is to provide a ladder rack for use with an extension ladder that is relatively inexpensive to manufacture.

Yet another object of the present invention is to provide a ladder rack that is capable of holding several tools that are required while painting.

An additional object of the present invention is to provide a ladder rack for use with an extension ladder which is relatively light weight.

In addition to the various objects and advantages of the present invention described with some degree of specificity above it should be obvious that additional objects and advantages of the present invention will become more readily apparent to those persons who are skilled in the relevant art from the following more detailed description of the invention, particularly, when such description is taken in conjunction with the attached drawing figures and with the appended claims.

Figure 1:
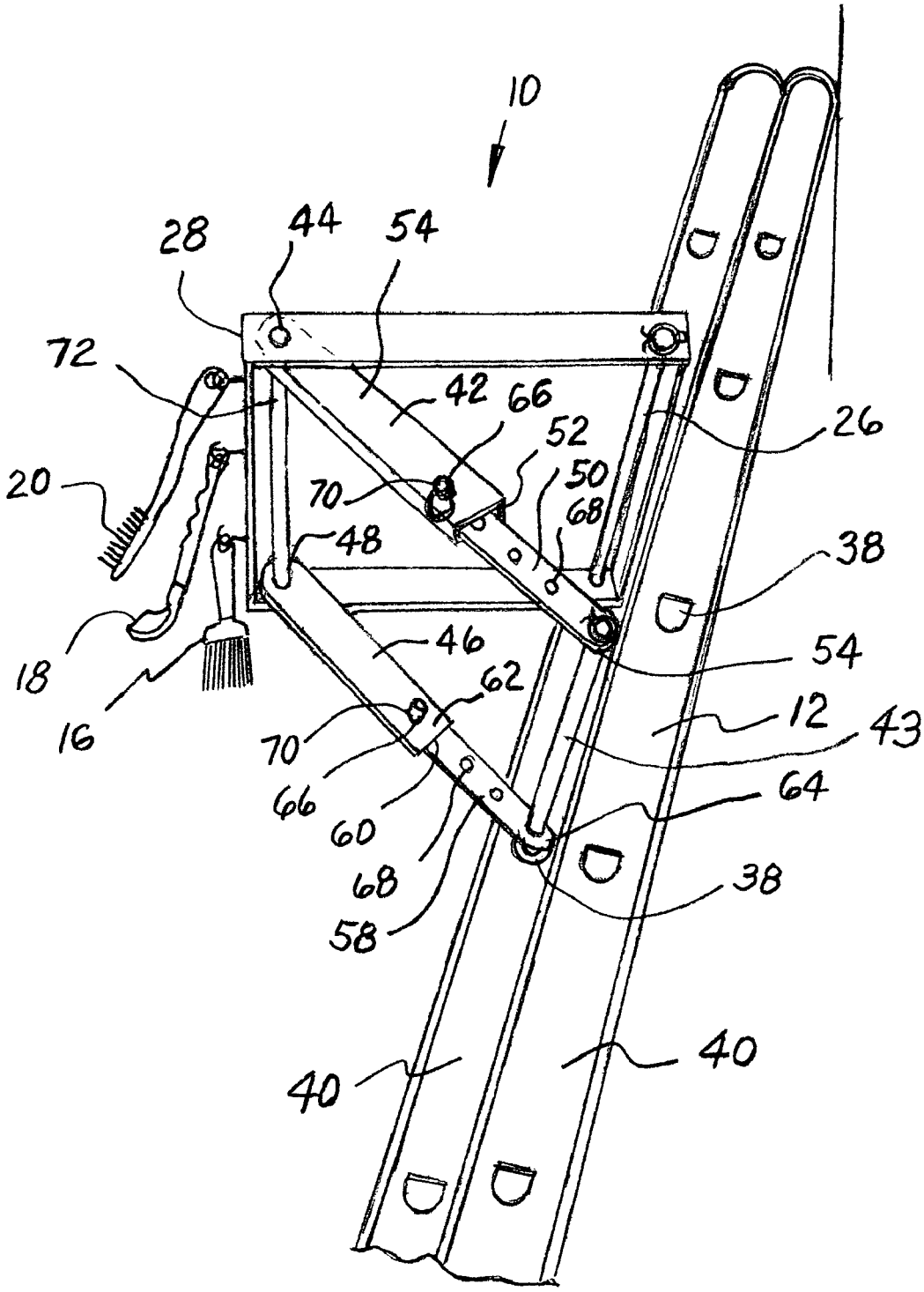
FIG. 1 is a perspective view of a presently preferred embodiment of the ladder rack according to the invention.

BRIEF DESCRIPTION OF A PRESENTLY PREFERRED AND VARIOUS ALTERNATIVE EMBODIMENTS OF THE INVENTION

Prior to proceeding to the more detailed description of the present invention it should be noted that, for the sake of clarity and understanding, identical components which have identical functions have been identified with identical reference numerals throughout the several views illustrated in the drawing figures.

Figure 2:
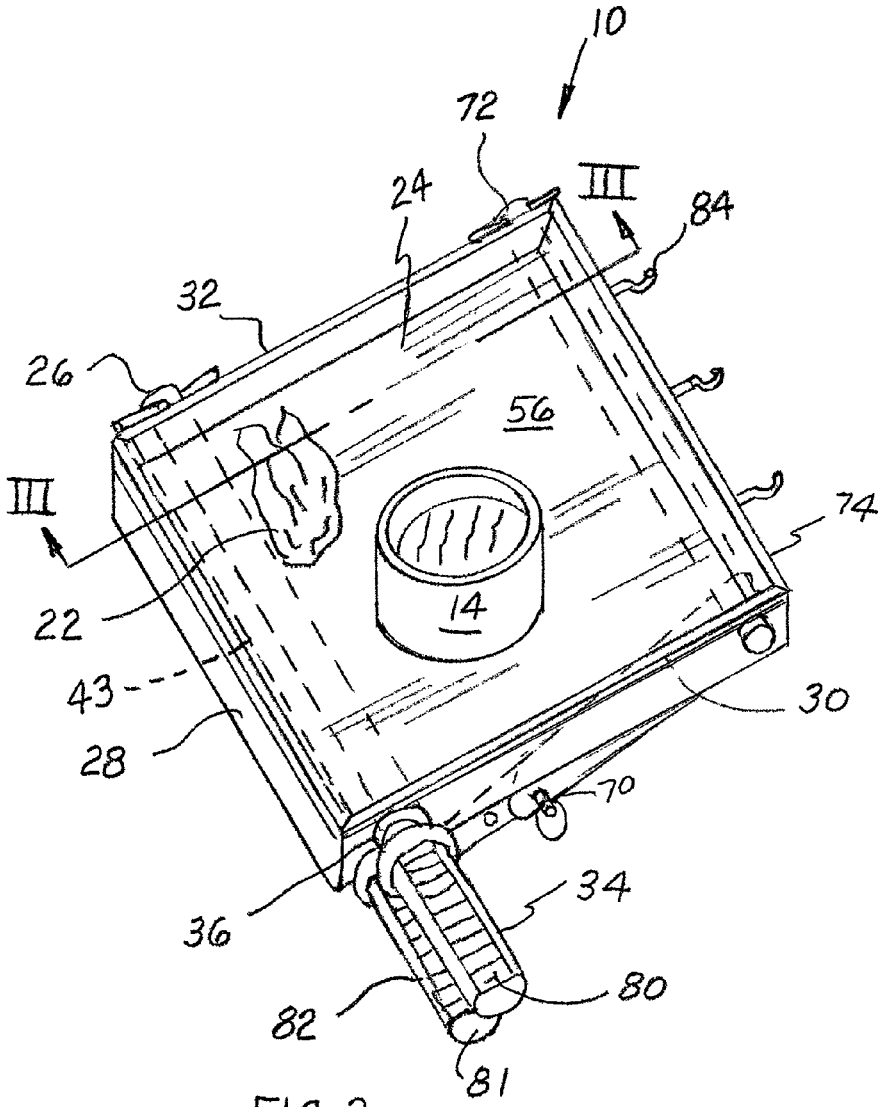
FIG. 2 is a top view of the ladder rack illustrated in FIG. 1.
Figure 3:
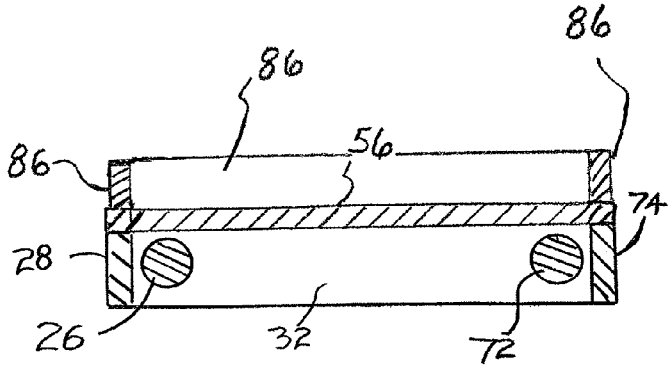
FIG. 3 is a sectional view of the platform portion of the rack as indicated on FIG. 2.

Reference is now made, more particularly, to FIGS. 1-3 of the drawings. Illustrated therein is an apparatus, generally designated 10, for use on an extension type ladder 12 for at least one of holding a paint can 14 or paint pan (not shown) for use with a roller (not shown) in a substantially horizontal plane, a paint brush 16, a paint scraper 18, a wire or other stiff bristle brush 20 and a cloth 22.

Such apparatus 10 includes a platform member 24, which when in use, is disposed in a substantially horizontal plane. The platform member 24 is formed from a first predetermined material and has each of a predetermined shape and a predetermined thickness. The predetermined thickness is at least sufficient to hold a one gallon paint can 14 full of paint.

In the presently preferred embodiment of the instant invention such first predetermined material for manufacturing the platform member 24 from will be selected from the group consisting of wood and plastic. Additionally, the presently preferred predetermined shape of such platform member 24 will be substantially rectangular. The most preferred predetermined shape of the platform member 24 is square.

Apparatus 10 further includes a first elongated rod like support member 26 that is secured to such platform member 24 in a rotateable manner closely adjacent a first predetermined outer edge thereof 28. The first elongated rod like support member 26 has a first predetermined length which predetermined length will be at least sufficient to extend outwardly for a predetermined distance from each of a second predetermined outer edge 30 and a third predetermined outer edge 32 of the platform member 24.

There is a first ladder insert 34 provided which has each of a predetermined shape and a predetermined length engageable with a predetermined end 36 of the first elongated rod like member 26 and a first aperture 38 formed through a leg member 40 of such extension ladder 12.

Apparatus 10 has a first leg member 42 secured at a first end 44 thereof to such platform member 24 closely adjacent the second predetermined outer edge 30 of such platform member 24. The first leg member 42 of apparatus 10 being pivotable adjacent such first end 44 thereof.

Additionally, apparatus 10 has a second leg member 46 secured at a first end 48 thereof to such platform member 24 closely adjacent such third predetermined outer edge 32 of such platform member 24. The second leg member 46 also being pivotable adjacent such first end 48 thereof.

There is a first adjustable leg member 50, in apparatus 10, engageable at a first end 52 thereof to a second end 54 of such first leg member 42 for adjusting the length between a second end 54 of first adjustable leg member 50 and such first end 44 of the first leg member 42 in order to assist in providing a substantially horizontally disposed upper surface 56 of such platform member 24 during use of the apparatus 10.

Further, there is a second adjustable leg member 58 engageable at a first end 60 thereof to a second end 62 of such second leg member 46 for adjusting the length between a second end 64 of such second adjustable leg member 58 and such first end 48 of the second leg member 46 to assist in providing the substantially horizontally disposed upper surface 56 of such platform member 24 during use of the apparatus 10.

In the presently preferred embodiment of the invention, each of the first leg member 42 and-such second leg member 46 includes at least one aperture 66 formed therethrough and each of such first adjustable leg member 50 and the second adjustable leg member 58 includes a predetermined plurality of apertures 68 formed therethrough. One of such predetermined plurality of apertures 68 formed through the first adjustable leg member 50 and such second leg member 46 being aligned with such at least one aperture 66 formed through a respective one of such first leg member 42 and the second leg member 46 and the apparatus 10 further includes a pair of pull type pins 70. One of such pair of pull type pins 70 engageable through the aligned apertures 66 and 68 of such first leg member 42 and the first adjustable leg member 50 and a second one of such pair of pull type pins 70 engageable through aligned apertures 66 and 68 of such second leg member 46 and such second adjustable leg member 58.

Apparatus 10 includes a second elongated rod like support member 72 secured to such platform member 24 in a rotateable manner closely adjacent a fourth predetermined outer edge 74. Such fourth predetermined outer edge 74 is disposed radially opposite such first outer edge 28 of platform member 24. The second elongated rod like support member 72 has a second predetermined length which is also at least sufficient to extend outwardly from each of the second predetermined outer edge 30 and the third predetermined outer edge 32 of such platform member 24. Apparatus 10 further includes a third elongated rod like support member 43 secured to distal ends of leg extensions 54 and 64.

The final essential component of apparatus 10 is a second ladder insert 81 having each of a predetermined shape and a predetermined length engageable with a predetermined end of such third elongated rod like member 72 and a second aperture 78 formed through a leg member 40 of such extension ladder 12.

In the presently preferred embodiment of the invention, each of such first insert member 34 and such second insert member 81 is engageable with either end of a respective one of the first rod like member 26 and the third rod like member 43. The predetermined shape of each of the first insert member 26 and such second insert member 81 includes a substantially flat surface 80 and an arcuate surface 82.

In the presently preferred embodiment of the instant invention, such apparatus 10 will further includes at least one hook like member 84 disposed adjacent such fourth outer edge 74 of the platform member 24 for holding at least one of a paint brush, a paint scraper, a wire or other stiff bristle brush and a cloth. Preferably, such apparatus 10 will include a plurality of such hook like members 84.

Additionally, in the presently preferred embodiment, apparatus 10, which has one edge thereof abutting an exterior surface of one of the ladder side rails, will also have a lip member 86 formed from a second predetermined material, preferably wood or plastic, extending each of above an upper surface 56 of the platform member 24 and around a perimeter of such platform member 24 for a predetermined distance to prevent an article disposed on the upper surface 56 of platform member 24 from sliding off. Preferably, the lip member 86 will extend above the upper surface 56 of platform member 24 at least about 0.25 inch.

While a presently preferred and various alternative embodiments of the present invention have been described in sufficient detail above to enable a person skilled in the relevant art to make and use the same it should be obvious that various other adaptations and modifications can be envisioned by those persons skilled in such art without departing from either the spirit of the invention or the scope of the appended claims.

I claim:

1. An apparatus for use on an extension type ladder for at least one of holding a paint can in a substantially horizontal plane, a paint brush, a paint scraper, a wire brush and a cloth, said apparatus comprising:

(a) a platform member, which when in use, is disposed in a substantially horizontal plane and has an outer surface of one edge thereof disposed adjacent an exterior surface of one of a pair of side rails, said platform member formed from a first predetermined material and having each of a predetermined shape and a predetermined thickness which thickness is at least sufficient to hold a one gallon can full of paint;

(b) a first elongated rod like support member secured to said platform member in a rotatable manner closely adjacent a first predetermined outer edge thereof, said first elongated rod like support member having a first predetermined length which is at least sufficient to extend outwardly from each of a second predetermined outer edge and a third predetermined outer edge of said platform member;

(c) a first ladder insert having each of a predetermined shape and a predetermined length engageable with a predetermined end of said first elongated rod like member and a first aperture formed through one of said side rails of such extension ladder;

(d) a first leg member secured at a first end thereof to said platform member closely adjacent said second predetermined outer edge of said platform member, said first leg member being pivotable adjacent said first end thereof;

(e) a second leg member secured at a first end thereof to said platform member closely adjacent said third predetermined outer edge of said platform member, said second leg member being pivotable adjacent said first end thereof;

(f) a first adjustable leg member engageable at a first end thereof to a second end of said first leg member for adjusting a length between a second end of said first adjustable leg member and said first end of said first leg member in order to assist in providing a substantially horizontally disposed upper surface of said platform member during use of said apparatus;

(g) a second adjustable leg member engageable at a first end thereof to a second end of said second leg member for adjusting a length between a second end of said second adjustable leg member and said first end of said second leg member in order to assist in providing a substantially horizontally disposed upper surface of said platform member during use of said apparatus;

(h) a second elongated rod like support member secured to said platform member in a rotatable manner closely adjacent a fourth predetermined outer edge thereof disposed radially opposite said first outer edge of said platform member, said second elongated rod like support member having a second predetermined length which is at least sufficient to extend outwardly from each of said second predetermined outer edge and said third predetermined outer edge of said platform member;

(i) a third elongated rod member secured to distal ends of both said adjustable leg members; and (j) a second ladder insert having each of a predetermined shape and a predetermined length engageable with a predetermined end of said third elongated rod like member and a second aperture formed through said side rail of such extension ladder.

2. An apparatus, according to claim 1, wherein said apparatus further includes at least one hook like member disposed adjacent said fourth outer edge of said platform member for holding at least one of said paint brush, said paint scraper, said wire brush and said cloth.

3. An apparatus, according to claim 2, wherein said apparatus further includes a predetermined number of hook like members.

4. An apparatus, according to claim 1, wherein said predetermined shape of said platform member is substantially rectangular.

5. An apparatus, according to claim 4, wherein said predetermined shape of said platform member is substantially square.

6. An apparatus, according to claim 1, wherein each of said first leg member and said second leg member includes at least one aperture formed therethrough and each of said first adjustable leg member and said second adjustable leg member includes a predetermined plurality of apertures formed therethrough, one of said predetermined plurality of apertures formed through said first adjustable leg member and said second leg member being aligned with said at least one aperture formed through a respective one of said first leg member and said second leg member and said apparatus further includes a pair of pull type pins, one of said pair of pull type pins engageable through aligned apertures of said first leg member and said first adjustable leg member and a second one of said pair of pull type pin members engageable through aligned apertures of said second leg member and said second adjustable leg member.

7. An apparatus, according to claim 1, wherein each of said first insert member and said second insert member is engageable with either end of a respective one of said first rod like member and said third rod like member.

8. An apparatus, according to claim 1 wherein said predetermined shape of each of said first insert member and said second insert member includes a substantially flat elongated surface and an elongated arcuate surface.

9. An apparatus, according to claim 1, wherein said apparatus further includes a lip member, formed from a second predetermined material, extending each of above an upper surface of said platform member and around a perimeter of said platform member for a predetermined distance to prevent an article disposed on said upper surface of said platform member from sliding off.

10. An apparatus, according to claim 9, wherein said predetermined distance said lip member extends above said upper surface of said platform member is at least about 0.25 inch.

11. An apparatus, according to claim 1, wherein said first predetermined material is selected from the group consisting of wood and plastic.

12. An apparatus for use on an extension type ladder for at least one of holding a paint can in a substantially horizontal plane, a paint brush, a paint scraper, a wire brush and a cloth, said apparatus comprising:

(a) a platform member which, when in use, is disposed in a substantially horizontal plane with an outer surface of one edge thereof disposed adjacent an outer surface of one side rail of the ladder, said platform member formed from a first predetermined material and having a lip member extending from an upper surface around a perimeter;

(b) a first elongated rod like support member secured to said platform member in a rotatable manner closely adjacent a first predetermined outer edge thereof, said first elongated rod like support member having a first predetermined length which is at least sufficient to extend outwardly from each of a second predetermined outer edge and a third predetermined outer edge of said platform member;

(c) a first ladder insert having each of an elongated arcuate surface and an elongated flat surface engageable with a first aperture formed through said side rail of such extension ladder and a predetermined end of said first elongated rod like member;

(d) a first leg member secured at a first end thereof to said platform member closely adjacent said second predetermined outer edge of said platform member, said first leg member being pivotable adjacent said first end thereof, and wherein an aperture is formed therethrough adjacent a second end and edges of said first leg member form a channel therewith, and;

(e) a second leg member secured at a first end thereof to said platform member closely adjacent said third predetermined outer edge of said platform member, said second leg member being pivotable adjacent said first end thereof and wherein edges of said second member form a channel therewith;

(f) a first adjustable leg member with a plurality of apertures therethrough and engageable at a first end thereof with said channel of said first leg member for adjusting a length between a second end of said first adjustable leg member, and further engageable with a pull pin through said aperture in said second end of said first leg member in order to assist in providing a substantially horizontally disposed upper surface of said platform member during use of said apparatus;

(g) a second adjustable leg member engageable at a first end thereof with said channel of said second leg member for adjusting a length between a second end of said second adjustable leg member and said first end of said second leg member in order to assist in providing a substantially horizontally disposed upper surface of said platform member during use of said apparatus;

(h) a second elongated rod like support member secured to said platform member in a rotatable manner closely adjacent a fourth predetermined outer edge thereof disposed radially opposite said first outer edge of said platform member, said second elongated rod like support member having a second predetermined length which is at least sufficient to extend outwardly from each of said second predetermined outer edge and said third predetermined outer edge of said platform member;

(i) a third elongated rod member secured to distal ends of both said adjustable leg members; and (j) a second ladder insert having each of an elongated arcuate surface and an elongated flat surface engageable with a second aperture formed through said side rail of the extension ladder and a predetermined end of said third elongated rod like member.

13. In combination with a ladder, an apparatus comprising:

(a) a platform member having an upper surface disposed in a substantially horizontal plane when said platform member is attached to said ladder, a quartet of outer edges disposed below said upper surface in a substantially vertical plane when said platform member is attached to said ladder and a peripheral lip upstanding on said upper surface, wherein an outer surface of one of said quartet of outer edges is disposed adjacent an outer side of one side rail of said ladder;

(b) a first elongated rod like support member secured to said platform member in a rotatable manner closely adjacent a first predetermined outer edge thereof, said first elongated rod like support member having a first predetermined length which is at least sufficient to extend outwardly from each of a second predetermined outer edge and a third predetermined outer edge of said platform member;

(c) a first elongated ladder insert defined by each of an elongated arcuate surface and an elongated flat surface and having a uniform solid cross-section throughout in a plane transverse to a length of said first elongated ladder insert and between ends thereof, wherein one end of said first elongated ladder insert engages one end of said first rod like member and wherein said first elongated ladder insert is inserted into a first aperture formed through one side rail of said ladder;

(d) a pair of first leg members disposed in a parallel spaced relationship with one another, each of said pair of first leg members having a first portion, a pair of second portions upstanding on said first portion along longitudinal edges thereof, said first portion pivotally secured at a first end thereof to a respective one of said second and third predetermined outer edges of said platform member closely adjacent a forth predetermined outer edge of said platform member, and an aperture formed through said first portion adjacent to and spaced from a second end thereof;

(e) a pair of second leg members disposed in said parallel spaced relationship with one another, each of said pair of second leg members having one surface thereof disposed generally coplanar with one surface of a respective one of said pair of first leg members and having a plurality of spaced apart apertures formed through said each of said pair of second leg members along a length thereof;

(f) a second elongated rod like support member secured to said platform member in a rotatable manner closely adjacent said fourth predetermined outer edge thereof disposed opposite said first outer edge of said platform member, said second elongated rod like support member having a second predetermined length which is at least sufficient to extend through apertures formed in said first portion of first leg members adjacent first ends thereof and to further extend outwardly from said each of said second predetermined outer edge and said third predetermined outer edge of said platform member;

(g) a third elongated rod member pivotally securing distal ends of said pair of second leg members; and (h) a second elongated ladder insert defined by each of an elongated arcuate surface and an elongated flat surface engageable and having a uniform solid cross-section throughout in a plane transverse to a length of said second elongated ladder insert and between ends thereof, wherein one end of said second elongated ladder insert engages one end of said third rod like member and wherein said second elongated ladder insert is inserted into a second aperture formed through said side rail of said ladder;

(i) a pair of pull pins, each of said pair of pull pins having an end thereof passed through a selected one of said plurality of spaced apart apertures formed through said respective second leg member and aligned with said aperture formed through said first portion adjacent said second end thereof so as to position said upper surface of said platform member in said substantially horizontal plane when said platform member is attached to said ladder.

* * * * *